US008734561B2

(12) United States Patent
Larsson

(10) Patent No.: US 8,734,561 B2
(45) Date of Patent: May 27, 2014

(54) IRON BASED POWDER COMPOSITION

(75) Inventor: Mats Larsson, Lerberget (SE)

(73) Assignee: Hoganas AB (Pub), HOganas (SE)

( * ) Notice: Subject to any disclaimer, the term of this patent is extended or adjusted under 35 U.S.C. 154(b) by 176 days.

(21) Appl. No.: 13/503,533

(22) PCT Filed: Oct. 26, 2010

(86) PCT No.: PCT/EP2010/066182

§ 371 (c)(1),
(2), (4) Date: May 9, 2012

(87) PCT Pub. No.: WO2011/051293

PCT Pub. Date: May 5, 2011

(65) Prior Publication Data

US 2012/0219450 A1 Aug. 30, 2012

Related U.S. Application Data

(60) Provisional application No. 61/254,921, filed on Oct. 26, 2009.

(30) Foreign Application Priority Data

Oct. 26, 2009 (SE) ..... 0950794

(51) Int. Cl.
*B22F 1/00* (2006.01)
*B22F 3/12* (2006.01)
*B22F 3/24* (2006.01)

(52) U.S. Cl.
USPC ..... 75/252; 75/231; 75/243; 75/246; 419/11; 419/23; 419/29; 419/35; 419/36; 419/39

(58) Field of Classification Search
CPC .... B22F 1/0059; B22F 1/0062; B22F 1/0077; C22C 33/0207
USPC ..... 75/231, 243, 246, 252; 419/11, 23, 29, 419/35, 36, 39
See application file for complete search history.

(56) References Cited

U.S. PATENT DOCUMENTS

| | | | | |
|---|---|---|---|---|
| 3,357,818 | A | 12/1967 | Findeisen | |
| 5,782,954 | A | 7/1998 | Luk | |
| 6,696,014 | B2 * | 2/2004 | Nakamura et al. | 419/11 |
| 6,887,295 | B2 * | 5/2005 | Poszmik et al. | 75/252 |
| 7,125,435 | B2 * | 10/2006 | Poszmik et al. | 75/252 |
| 7,163,569 | B2 | 1/2007 | Toyoshima et al. | |
| 7,682,558 | B2 * | 3/2010 | Knutsson et al. | 419/37 |
| 2002/0146341 | A1 | 10/2002 | Mars et al. | |
| 2005/0139039 | A1 | 6/2005 | Larsson et al. | |

FOREIGN PATENT DOCUMENTS

| | | | |
|---|---|---|---|
| EP | 1 773 526 | B1 | 4/2007 |
| WO | WO 98/25720 | A1 | 6/1998 |
| WO | WO 2007/078232 | A1 | 7/2007 |

OTHER PUBLICATIONS

International Search Report (PCT/ISA/210) issued on Mar. 11, 2011, by European Patent Office as the International Searching Authority for International Application No. PCT/EP2010/066182.

Written Opinion (PCT/ISA/237) issued on Mar. 11, 2011, by European Patent Office as the International, Searching Authority for International Application No. PCT/EP2010/066182.

Myers, N. et al. Sintering of PIM Fe-2Ni-0.8C, PM2Tec2004, Chicago, IL, Jun. 13-17, 2004.†

* cited by examiner
† cited by third party

*Primary Examiner* — George Wyszomierski
*Assistant Examiner* — Ngoclan T Mai
(74) *Attorney, Agent, or Firm* — Buchanan Ingersoll & Rooney P.C.

(57) ABSTRACT

A bonded metallurgical powder composition including: an iron-based powder having a weight average particle size in the range of 20-60 μm, in an amount of at least 80 percent by weight of the composition, graphite powder in an amount between 0.15-1.0 percent by weight of the composition, a binding agent in an amount between 0.05-2.0 percent by weight of the composition, a flow agent in an amount between 0.001-0.2 percent by weight of the composition; wherein the graphite powder is bound to the iron-based powder particles by means of the binding agent, and wherein the powder composition has an apparent density of at least 3.10 g/cm$^3$ and a hall flow rate of at most 30 s/50 g. Also, a method for producing a sintered component with improved strength from the inventive composition, as well as to a heat treated sintered component produced according to said method.

26 Claims, 1 Drawing Sheet

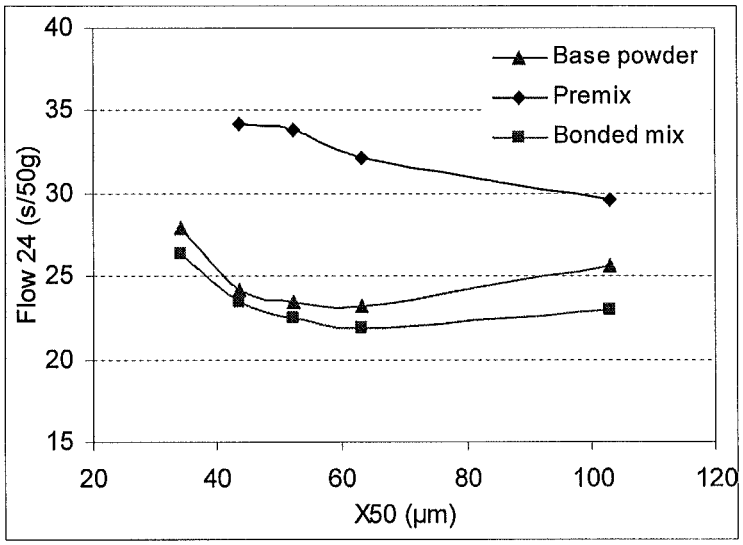
Base powder
Premix
Bonded mix
Flow 24 (s/50g)
40
35
30
25
20
15
20
40
60
80
100
120
X50 (μm)

IRON BASED POWDER COMPOSITION

FIELD OF THE INVENTION

The present invention concerns an iron-based composition, the method of making sintered components from the powder composition, and sintered components made from the powder composition. The powder composition is designed to obtain sintered parts with improved fatigue strength, combined with optimal powder properties, such as flow rate and apparent density of the powder composition.

BACKGROUND OF THE INVENTION

In industries the use of metal products manufacturing by compaction and sintering metal powder compositions is becoming increasingly widespread. A number of different products of varying shape and thickness are being produced and the quality requirements are continuously raised at the same time as it is desired to reduce the cost. As net shape components, or near net shape components requiring a minimum of machining in order to reach finished shape, are obtained by pressing and sintering of iron powder compositions, which implies a high degree of material utilisation, this technique has a great advantage over conventional techniques for forming metal parts such as moulding or machining from bar stock or forgings.

One problem connected to the press and sintering method is however that the sintered component contains a certain amount of pores, decreasing the strength of the component. Basically there are two ways to overcome the negative effect on mechanical properties caused by the component porosity: 1) The strength of the sintered component may be increased by introducing alloying elements such as carbon, copper, nickel molybdenum etc. 2) The porosity of the sintered component may be reduced by increasing the compressibility of the powder composition, and/or increasing the compaction pressure for a higher green density, or increasing the shrinkage of the component during sintering. In practise a combination of strengthening the component by addition of alloying elements and minimising the porosity is applied.

There are three common ways of alloying iron powders: prealloying, admixing and diffusion alloying.

During sintering, metal powder particles of the compacted or pressed component, the green component, will diffuse together in solid state forming strong bonds, so called sintering necks. The result is a relatively high dense net shape, or near net shape, part suitable for low or medium performance applications. Typically, sintered articles are manufactured from iron powder mixed with copper and graphite powders. Other types of materials suggested include iron powder prealloyed with nickel and molybdenum and small amounts of manganese to enhance iron hardenability without developing stable oxides. Machinability enhancing agents such as MnS are also commonly added.

As mentioned in US2002/0146341A1, dynamic mechanical properties of a sintered component, such as fatigue strength, are affected by the size of the pores. The lower the amount of large pores present in the sintered structure, the better the dynamic mechanical properties. US2002/0146341A1 describes the use of fine lubricant particles in order to improve dynamic properties.

An effective way to decrease the pore size in a sintered structure is to use finer powders when compacting. However, fine powder compositions are not free flowing and can therefore not be used commercially.

Agglomeration has been suggested to improve flow of fine powders (WO98/25720, U.S. Pat. No. 7,163,569B2), by increasing the mean particle size of the particles in the process. One disadvantage with agglomeration is that porosity will form between the bonded small particles as well as between the agglomerated particles, thus reducing the apparent density of the powder composition and consequently tool cavities with larger fill depth are required.

WO 2007/078232 discloses the use of a combination of fatty alcohol, lubricant and flow agent to reduce powder segregation and dusting, improve powder flow and apparent density, as well as to reduce the ejection force and dimensional spread of the green component of compacted powder. This document does not specifically relate to fine powders.

OBJECTS OF THE INVENTION

An object of the invention is to provide an iron-based powder composition suitable for producing sintered components with improved fatigue strength, having good powder properties, such as flow and apparent density.

Another object of the invention is to provide a method for producing sintered components with improved fatigue strength.

SUMMARY OF THE INVENTION

At least one of these objects, as well as other objects that will be apparent from the discussions below, is accomplished by the present invention, which according to one aspect provides a bonded metallurgical powder composition comprising: an iron-based powder having a weight average particle size in the range of 20-60 μm, in an amount of at least 80 percent by weight of the composition, graphite powder in an amount between 0.15-1.0 percent by weight of the composition, a binding agent in an amount between 0.05-2.0 percent by weight of the composition, a flow agent in an amount between 0.001-0.2 percent by weight of the composition; wherein the graphite powder is bound to the iron-based powder particles by means of the binding agent, and wherein the powder composition has an apparent density of at least 3.10 g/cm$^3$ and a hall flow rate of at most 30 s/50 g.

According to another aspect, the present invention provides a method for producing a sintered component with improved strength comprising: providing a powder composition according to the above aspect of the present invention; subjecting the composition to compaction at between 400 and 2000 MPa to produce a green component; sintering the green component in a reducing atmosphere at a temperature between 1000-1400° C.; and subjecting the sintered component to heat treatment, such as quenching and/or tempering. Alternatively a sinterhardening process may be used.

According to another aspect, the present invention provides a heat treated sintered component produced according to the above method aspect of the present invention.

It has surprisingly been found that it is possible to obtain good flow and apparent density of a fine powder composition without agglomeration of the iron-based powder particles. This is according to the present invention achieved by preparing a special type of bonded powder composition, whereby smaller particles, such as graphite and other. alloying elements are bound to the relatively larger fine iron-based particles. This is surprising especially since the average particle size of the bonded composition is only slightly increased as compared with the particle size of the base powder. Even more surprisingly, it was found that compacted and sintered components produced from the bonded fine powder composition have improved strength and ductility as compared with corresponding components produced from coarser powders or non-bonded powders. It has previously been thought that it was impossible to obtain flow of fine powders that is fast and uniform enough to allow continuous industrial production of high strength components, wherein the components have homogenous properties throughout each component as well as when comparing different components. It has thus been found that it is possible to obtain components with good strength properties produced from a fine iron-based powder having a weight average particle size below about 60 μm, even more preferably below 50 μm, as measured by laser diffraction, such as with Sympatec equipment giving smaller pores in the resulting compacted part, from a continuous and industrially useful process.

However, it has also been found that the improved properties of the fine powder composition are not maintained for compositions with too fine iron-based powders. If the weight average particle size is too low, the improved hall flow is not maintained even for the bonded composition. Also the compressibility is decreased with decreasing particle size, giving lower green densities. It has also, surprisingly, been found that the tensile strength and the fatigue strength of the sintered components produced from the powder composition is not further improved if the powder composition has a too small average particle size. If fact, it appears that the tensile strength and the fatigue strength may even be reduced with too small average particle size. Hence, it has been found that the weight average particle size should be above about 20 μm, even more preferably above 30 μm, such as above 40 μm.

As discussed above, it is important that the powder composition has a good Hall flow rate. Thus, the inventive composition has a hall flow rate of at most 30 s/50 g. It may be convenient with an even more improved hall flow rate of at most 28 s/50 g, such as at most 26 s/50 g or at most 24 s/50 g.

As also discussed above, it is important that the powder composition has a high apparent density. Thus, the inventive composition has an apparent density of at least 3.10 g/cm$^3$. It may be convenient with an even higher apparent density of 3.15 g/cm$^3$, such as 3.20 g/cm$^3$.

The powder metallurgical composition contains an iron or iron-based powder in an amount of at least 80% by weight of the powder metallurgical composition, such as at least 90% by weight of the powder metallurgical composition. The iron-based powder may be any type of iron-based powder such as a water-atomised iron powder, reduced iron powder, pre-alloyed iron-based powder or diffusion alloyed iron-based powder. Graphite, as an alloying element, is bonded to the iron-based powder. Also other alloying elements may optionally be included in the powder composition and bonded to the iron-based powder. Examples of alloying elements which are bonded to the iron or iron-based particles may be selected from the group consisting of graphite, Cu, Ni, Cr, Mn, Si, V, Mo, P, W, S and Nb. These additives are generally powders having a smaller particle size than the base iron powder, and most alloying elements have an average particle size smaller than about 20 μm. The amount of the alloying elements in the powder metallurgical composition depends on the specific alloying element and the desired final properties of the sintered component. Specifically, it may be convenient to include copper and/or nickel as alloying elements. For example, the composition may include up to 3.0 wt % of copper and/or up to 3.0 wt % of nickel.

At least one of the alloying elements may be bound to the iron-based powder particles by means of a thermal diffusion bonding process.

Other pulverulent additives which may be present, and may be bonded to the iron-based powder particles, are hard phase materials, liquid phase forming materials and machinability enhancing agents.

After bonding, the mean particle size may increase, since a particle may then comprise also bound alloying elements and/or other additives as well as the iron-based powder particles. However, some additive particles may be unbound, reducing the mean particle size. The mean particle size might not change by more than about 20% as compared with the iron-based base powder by itself. Thus, the bound composition may also have a mean particle size below 60 μm, conveniently below 50 μm, and above 20 μm, conveniently above 30 μm, such as above 40 μm.

The binding agent may be any suitable binding agent, such as: polyethylene waxes with molecular weight in the range of 500-3000 g/mol; stearic acids; primary or secondary, saturated or unsaturated fatty amides; fatty acid bisamides; but it may be convenient to use a fatty alcohol as binding agent. Fatty alcohols used for binding the alloying elements and/or optional additives are preferably saturated, straight chained and contain 14 to 30 carbon atoms as they have an advantageous melting point for the melt-bonding technique used for binding the alloying elements and/or other optional additives. The fatty alcohols are preferably selected from the group consisting of cetyl alcohol, stearyl alcohol, arachidyl alcohol, behenyl alcohol and lignoceryl alcohol, and most preferably selected from the group consisting of stearyl alcohol, arachidyl alcohol and behenyl alcohol. The amount of fatty alcohol used may be between 0.05 and 2, preferably between 0.1 and 1 and most preferably between 0.1 and 0.8, % by weight of the metallurgical composition. Also combinations of fatty alcohols may be used as binder. The wording binder or the equivalent wording binding agent may have lubricating properties, and which case the binder may be regarded as being a lubricating binder.

In order to impart satisfactory flow to the new powder compositions, a flow agent is added. Such agent is previously known from e.g. the U.S. Pat. No. 3,357,818 and U.S. Pat. No. 5,782,954 which discloses that metal, metal oxides or silicon oxide can be used as flow agent. Especially good results have been obtained when carbon black is used as flow agent. The use of carbon black as flow agent is disclosed in the Swedish patent application 0401778-6. It has been found that the amount of flow agent such as carbon black should be between 0.001 and 0.2% by weight, preferably between 0.01 and 0.1%. Furthermore it has been found that the primary particle size of the carbon black may conveniently be below 200 nm, more preferably below 100 nm and most preferably below 50 nm.

BRIEF DESCRIPTION OF THE DRAWING

FIG. 1 is a diagram illustrating the correlation between hall flow and weight average particle size (X50) of compositions according to the invention compared with premix compositions and base powder.

DETAILED DESCRIPTION OF THE INVENTION

Preparation of Iron-Based Base Powder

Pure iron, or iron-based, powder may be produced by water atomization of an iron melt optionally including alloying elements, such as Molybdenum, Chromium, Nickel or Manganese. The atomized powder can further be subjected to a reduction annealing process, and optionally be alloyed by using a diffusion alloying process. Alternatively, the iron-based powder may be admixed with alloying elements in powder form, as discussed below. The particle size of the iron-based powder according to the invention may be small enough to ensure that at least 98 wt % of the powder pass through a 75 μm sieve, preferably a 63 μm sieve. However, it may be inconvenient to allow the particles to be too small. For this reason, a maximum of 15% by weight, such as a maximum of 10% by weight of the powder may pass through a 15 μm sieve or should be less than 15 μm. It may thus be convenient to use powders having a weight average particle size in the range of 20-60 μm, preferably 30-50 μm.

Powder Composition

Before compaction, the iron-based powder may be mixed with graphite, and optionally with copper powder and/or lubricants, and possibly with hard phase materials and/or machinability enhancing agents.

In order to enhance strength and hardness of the sintered component, carbon may be introduced in the matrix. Carbon, C, may be added as graphite in an amount between 0.35-1.0% by weight of the composition. An amount less than 0.35 wt % C may result in a too low strength and an amount above 1.0 wt % C may result in an excessive formation of carbides, yielding a too high hardness and worsening the machinability properties. In case the heat treatment of the sintered component includes carburizing, the amount of added graphite may be less than 0.35 wt %, such as above 0.15 wt %.

Copper, Cu, is a commonly used alloying element in the powder metallurgical field. Cu will enhance the strength and hardness through solid solution hardening. Cu, will also facilitate the formation of sintering necks during sintering as copper melts before the sintering temperature is reached providing so called liquid phase sintering. The iron-based powder may optionally be mixed with Cu, preferably in an amount of 0-3 wt % of the powder composition.

Nickel, Ni, is a commonly used alloying element in the powder metallurgical field. The iron-based powder may optionally be mixed with Ni, preferably in an amount of 0-3 wt % of the powder composition.

The powder composition may further comprise molybdenum as an alloying element in an amount of up to 3.0 percent by weight of the composition.

Said molybdenum may be present in prealloyed form.

Molybdenum, Mo, improves the strength of PM steel through improved hardenability. Molybdenum prealloyed to iron-based powder, has a moderate effect on the hardness and compressibility of the powder.

Other substances such as hard phase materials and machinability enhancing agents, such as MnS, $MoS_2$, $CaF_2$, different kinds of minerals etc. may be added.

In order to enhance the compressibility of the powder composition, and to facilitate ejection of the green component, an organic lubricant or a combination of different organic lubricants may be added to the powder metallurgical composition. The lubricant may be present as a free particulate powder or bonded to the surface of the iron-based powder.

Although the fatty alcohol which is used as a binder also has lubricating properties it may be convenient to use an additional lubricant. The type of solid organic lubricant of the invention is not critical, but due to the disadvantages with metal organic lubricants (generating residues of metal oxides during sintering), the organic lubricant does preferably not include metal. Zinc stearate is a commonly used lubricant giving good flow properties and high AD. However besides generating residues of zinc oxide during sintering another drawback is that the material may generate stains on the surfaces of the sintered components. Thus the organic lubricant may be selected from a wide variety of organic substances having lubricating properties. Examples of such substances are fatty acids, waxes, polymers, or derivates and mixtures thereof. Preferred lubricants are primary amides, such as stearic amide, arachidic amide and behenic amide, secondary amides, such as stearylstearic amide, and bisamides, such as ethylene bis-stearamide.

Flow Enhancing Process

Since powder compositions with particle sizes according to the invention normally do not flow properly, it is important to enhance the flow rate before compaction. In order to achieve this, a flow enhancing process including providing a binder, flow agent, and optionally lubricant is used. Contrary to agglomeration processes, flow may thus be improved while apparent density and mean particle size are kept at similar levels. Also, the apparent density may be improved.

Sintering

The iron-based powder composition may be transferred into a mould and subjected to a compaction pressure of about 400-2000 MPa to a green density of above about 6.70 g/cm$^3$, preferably above 6.80 g/cm$^3$, more preferably above 6.90 g/cm$^3$ and even more preferably above 7.00 g/cm$^3$. The obtained green component is further subjected to sintering in a reducing atmosphere at a temperature of about 1000-1400° C. If the component is to be sintered at regular sintering temperatures, this is usually performed at 1000-1200° C., preferably 1050-1180° C., most preferably 1080-1160° C. If the component is to be sintered at high temperature this is usually performed at 1200-1400° C., preferably at 1200-1300° C., and most preferably at 1220-1280° C.

Post Sintering Treatments

The sintered component may be subjected to a heat treatment process, for obtaining a desired microstructure, such as a hardening process. The hardening process may include known processes such as quench and temper, case hardening, nitriding, carburizing, nitrocarburizing, carbonitriding, induction hardening and the like. Alternatively a sinter-hardening process at high cooling rate may be utilized. In case that heat treatment includes carburizing the amount of added graphite may be less than 0.35%, such as above 0.15 wt %.

Other types of post sintering treatments may be utilized such as surface rolling or shot peening which introduces compressive residual stresses enhancing the fatigue strength.

Properties of the Finished Component

Components according to the invention demonstrate an improvement in fatigue strength of around 20% as compared to components produced from non bonded iron powders of standard particle size, i.e. a powders that have passed a 250 μm sieve.

EXAMPLE

Example 1

Different fractions were sieved out from the powder Astaloy™ Mo, available from Höganäs AB.

1. Not sieved base powder (i.e. particles that have passed a 250 μm sieve)
2. −106 μm
3. −75 μm
4. −63 μm
5. −45 μm The particle size distribution of the fractions were analysed by laser diffraction (Sympatec), and Hall Flow and Apparent Density were measured according to ISO standards ISO4490 and 3923-1 after 24 hours from preparation of the mixes.

Of each powder fraction, mixtures were made with the following compositions:

Premix (reference): Astaloy™ Mo+0.2% graphite+0.8% Amidewax PM

Bonded mix: Astaloy™ Mo+0.2% graphite+0.8% Lubricating Binder+0.03% Flow Agent

Graphite (C-UF4) available from Kropfmühl and Amidewax PM lubricant available from Clariant was used. The lubricating Binder used was Behenylalcohol, and the flow agent carbon black with average particle size less than 50 nm.

The following analyses of the mixtures were made:

Chemical analysis of graphite and lubricant/binder contents

Hall Flow and Apparent Density, after 24 h.

Compressibility at 400 MPa, 600 MPa and 800 MPa, according to ISO 3927

Of each mix the following specimens were pressed at 700 MPa

Tensile Strength (TS) specimens according to ISO 2740

Impact Energy (IE) specimens according to ISO 5754

Fatigue Strength (FS) specimens according to ISO 3928, with chamfered edges

The specimens, including the green density (GD) specimens, were sintered at 1250° C., 30 minutes in an atmosphere of 90/10 vol % $N_2/H_2$. After the sintering the specimens were case hardened. Austenitization was carried out at 920° C. with 0.8% Carbon-potential and 30 min carburizing time followed by quenching in oil. The specimens were annealed at 180° C. for 60 min in air.

Sintered density and carbon content was evaluated on the TS-specimens. Impact energy was measured on the IE-specimens.

Fatigue strength was tested with plane bending, R=−1. Of each material, 25 specimens were tested. The edges of the specimens were carefully ground before testing to remove burr. For the evaluation the stair case method according to MPIF standard 56 was used. Tensile strength was measured according to ISO 6802-1.

All five bonded mixes were tested for tensile strength and fatigue strength. The Premix based on the standard fraction base powders and the Premix based on −45 μm fraction base powders were tested tensile strength and fatigue strength

TABLE 1

Properties of base powders of different particle size

| Property | Unit | Base powder fraction 1. (Standard) | 2. (−106 μm) | 3. (−75 μm) | 4. (−63 μm) | 5. (−45 μm) |
|---|---|---|---|---|---|---|
| X10 | (μm) | 42.5 | 31.1 | 27.4 | 24.2 | 20.4 |
| X50 | (μm) | 103.0 | 63.2 | 52.3 | 43.5 | 34.3 |
| X90 | (μm) | 203.5 | 104.3 | 82.7 | 67.6 | 50.5 |
| X90/X10 | | 4.8 | 3.4 | 3.0 | 2.8 | 2.5 |
| Hall Flow | (s/50 g) | 25.6 | 23.2 | 23.5 | 24.2 | 27.9 |
| AD | ($g/cm^3$) | 3.03 | 2.93 | 2.89 | 2.89 | 2.93 |

The X10 value indicates that 10 wt % of the total amount of particles are finer than the value presented. In the same way the X50 value indicates that 50 wt % of the total amount of particles are finer than the measured value. The results have been measured with laser diffraction (Sympatec)

TABLE 2

X50 comparison

| Sieve cut | Base Powder (μm) | Bonded Mix (wt %) | Change (%) |
|---|---|---|---|
| Standard, −250 μm | 103.0 | 97.5 | −5.34 |
| −106 μm | 63.2 | 66.8 | 5.70 |
| −75 μm | 52.3 | 57.1 | 9.18 |
| −63 μm | 43.5 | 49.9 | 14.71 |
| −45 μm | 34.3 | 37.1 | 8.16 |

Table 2 compares the average particle size of the bonded powder composition and the base powder. It can be seen that the change in average particle size due to the bonding process is small and well below 20%.

TABLE 3

Analyses of the mixes

| | | Sample | Graphite (%) | Lubricant (%) | AD24 (g/cm3) | Flow24 (s/50 g) | No of taps required |
|---|---|---|---|---|---|---|---|
| Premix | P-1 | Standard | 0.17 | 0.78 | 3.05 | 29.6 | |
| | P-2 | −106 μm | 0.21 | 0.79 | 2.95 | 32.1 | 2 |
| | P-3 | −75 μm | 0.17 | 0.80 | 2.94 | 33.8 | 4 |
| | P-4 | −63 μm | 0.19 | 0.79 | 2.96 | 34.2 | 10 |
| | P-5 | −45 μm | 0.19 | 0.78 | 3.07 | No flow | |
| Bonded mix | B-1 | Standard | 0.23 | 0.76 | 3.33 | 23.0 | |
| | B-2 | −106 μm | 0.21 | 0.76 | 3.26 | 21.9 | |
| | B-3 | −75 μm | 0.22 | 0.80 | 3.22 | 22.5 | |
| | B-4 | −63 μm | 0.22 | 0.78 | 3.23 | 23.5 | |
| | B-5 | −45 μm | 0.22 | 0.75 | 3.18 | 26.3 | |

Table 3 demonstrates that the powder composition according to the invention outperforms a non-bonded premix regarding flow and apparent density. As can be seen a normal premix does not flow freely and several taps on the Hall flow funnel are required in order to measure flow when particle sizes decrease.

FIG. 1 further illustrates that Hall flow behaviour of the composition according to the invention is similar to the base powder, rather than a premix. It can also be seen from this FIGURE that flow drastically worsens as X50 decreases

TABLE 4

| Compressibility of the mixes | | | | | |
|---|---|---|---|---|---|
| | | | Compressibility (g/cm³) | | |
| | Sample | | 400 MPa | 600 MPa | 800 MPa |
| Premix | P-1 | Standard | 6.67 | 7.08 | 7.25 |
| | P-2 | −106 μm | 6.62 | 7.04 | 7.22 |
| | P-3 | −75 μm | 6.59 | 7.02 | 7.21 |
| | P-4 | −63 μm | 6.57 | 7.00 | 7.20 |
| | P-5 | −45 μm | 6.52 | 6.96 | 7.17 |
| Bonded mix | B-1 | Standard | 6.63 | 7.03 | 7.21 |
| | B-2 | −106 μm | 6.58 | 7.01 | 7.21 |
| | B-3 | −75 μm | 6.56 | 7.00 | 7.20 |
| | B-4 | −63 μm | 6.54 | 6.99 | 7.20 |
| | B-5 | −45 μm | 6.52 | 6.97 | 7.19 |

TABLE 5

| Sintered density of GD specimens | | | | | |
|---|---|---|---|---|---|
| | | | Sintered density (g/cm³) | | |
| | Sample | | 400 | 600 | 800 |
| Premix | P-1 | Standard | 6.67 | 7.09 | 7.27 |
| | P-2 | −106 μm | 6.64 | 7.07 | 7.27 |
| | P-3 | −75 μm | 6.63 | 7.06 | 7.27 |
| | P-4 | −63 μm | 6.62 | 7.05 | 7.27 |
| | P-5 | −45 μm | 6.59 | 7.03 | 7.26 |
| Bonded mix | B-1 | Standard | 6.63 | 7.04 | 7.24 |
| | B-2 | −106 μm | 6.59 | 7.02 | 7.23 |
| | B-3 | −75 μm | 6.58 | 7.02 | 7.23 |
| | B-4 | −63 μm | 6.57 | 7.01 | 7.23 |
| | B-5 | −45 μm | 6.57 | 7.01 | 7.23 |

TABLE 6

| Static mechanical properties | | | | | | | |
|---|---|---|---|---|---|---|---|
| | | | Hardened | Tensile test | | Impact | Carbon |
| | Sample | | density (g/cm³) | TS (MPa) | A (%) | energy (J) | content (%) |
| Premix | P-1 | Standard | 7.22 | 1106 | 0.31 | 12.7 | 0.48 |
| | P-5 | −45 μm | 7.20 | 1142 | 0.36 | 15.7 | 0.49 |
| Bonded mix | B-1 | Standard | 7.18 | 1074 | 0.24 | 12.5 | 0.46 |
| | B-2 | −106 μm | 7.18 | 1162 | 0.34 | 14.0 | 0.45 |
| | B-3 | −75 μm | 7.16 | 1184 | 0.42 | 14.7 | 0.49 |
| | B-4 | −63 μm | 7.15 | 1202 | 0.46 | 16.6 | 0.48 |
| | B-5 | −45 μm | 7.16 | 1188 | 0.42 | 18.1 | 0.47 |

Table 6 demonstrates static mechanical properties for the specimens. Specimens made from the composition according to the invention attain higher levels of impact energy at a lower density than the reference. Higher tensile strength than the reference is also achieved.

TABLE 7

| Fatigue strength | | | | |
|---|---|---|---|---|
| | | | Fatigue strength | |
| | Sample | | σ50 | std. dev. (MPa) |
| Premix | P-1 | Standard | 448 | 42.8 |
| | P-5 | −45 μm | 542 | 8.7 |
| Bonded mix | B-1 | Standard | 478 | 16 |
| | B-2 | −106 μm | 534 | 11 |

TABLE 7-continued

| Fatigue strength | | | |
|---|---|---|---|
| | | Fatigue strength | |
| | Sample | σ50 | std. dev. (MPa) |
| | B-3 | −75 μm | 557 | 18 |
| | B-4 | −63 μm | 578 | 21 |
| | B-5 | −45 μm | 576 | <7.5 |

Table 7 clearly demonstrates that the composition according to the invention reaches higher fatigue levels than the reference. σ50 corresponds to the level of strength for which 50% of the specimens survive 2.000.000 cycles.

Example 2

Example 1 was repeated with the exception of that a fine particulate diffusion bonded powder was used, i.e. an iron powder having particles of alloying elements, 1 wt % Mo and 1.9 wt % Ni attached to the surface of the iron powder through a thermal diffusion process.

Particle size measurements with laser diffraction were performed on the diffusion bonded powder, results of the measurements according to table 8.

TABLE 8

| results from particle size measurements of diffusion bonded powder | |
|---|---|
| X10 | 25.4 μm |
| X50 | 45.0 μm |
| X90 | 68.1 μm |
| X99 | 92.3 μm |
| X90/X10 | 2.7 |

Further, a bonded mixture was prepared from the diffusion bonded powder according to the description of the bonding process in example 1 with the exception of that a mixture of Behenamide and Behenylalcohol was used instead of Behenylalcohol.

Hall Flow and Apparent Density were measured on the bonded mixture according to the description of example 1, the results from the tests according to table 9

TABLE 9

| Results from measurements of Hall Flow and apparent density | |
|---|---|
| Hall flow (seconds) | AD ($g/cm^3$) |
| 28.7 | 3.38 |

Tensile Strength (TS), Impact Energy (IE) and Fatigue Strength (FS) specimens were pressed at 700 MPa. The specimens were sintered, case hardened and annealed according to example 1 with the exception of that half of the number of specimens were sintered at 1120° C. and half of the number of specimens were sintered at 1250° C. Testing for tensile strength, impact energy and fatigue strength were performed according to example 1. The results from the testing according to table 10 and 11

TABLE 10

Results from testing of hardened density, tensile test, impact test and carbon content

| | Hardened | Tensile test | | Impact | |
|---|---|---|---|---|---|
| Sintering temperature | density ($g/cm^3$) | TS MPa | A % | Energy J | Carbon content |
| 1120° C. | 7.27 | 1329 | 0.78 | 20.4 | 0.38 |
| 1250° C. | 7.33 | 1425 | 0.91 | 29.8 | 0.40 |

TABLE 11

Results from testing of fatigue strength

| | Fatigue strength | |
|---|---|---|
| Sintering temperature | Σ50 MPa | std. dev MPa |
| 1120° C. | 522 | 25 |
| 1250° C. | 553 | 19 |

The results from table 10 and 11 shows clearly that bonded powder metallurgical compositions according to the present invention based on diffusion bonded powders can be used for producing components having very good static and dynamic mechanical properties.

While the invention has been described with reference to various exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed, but that the invention will include all embodiments falling within the scope of the appended claims.

The invention claimed is:

1. A bonded metallurgical powder composition comprising:

an iron-based powder having a weight average particle size in a range of 20-60 μm, in an amount of at least 80 percent by weight of the composition, graphite powder in an amount between 0.15-1.0 percent by weight of the composition, a binding agent in an amount between 0.05-2.0 percent by weight of the composition, a flow agent in an amount between 0.001-0.2 percent by weight of the composition;

wherein the graphite powder is bound to the iron-based powder particles by means of the binding agent, wherein the powder composition has an apparent density of at least 3.10 $g/cm^3$ and a hall flow rate of at most 30 s/50 g; and wherein the difference between the weight average particle size of said iron-based powder and the weight average particle size of said bonded metallurgical powder composition is at most 20%.

2. The powder composition of claim 1, wherein the iron-based powder has a weight average particle size in the range of 30-50 μm.

3. The powder composition of claim 1, having an apparent density of at least 3.15 $g/cm^3$.

4. The powder composition of claim 1, having a hall flow rate of at most 28 s/50 g.

5. The powder composition of claim 1, further comprising copper as an alloying element in an amount up to 3.0 percent by weight of the composition, wherein the alloying element is in powder form.

6. The powder composition of claim 1, further comprising nickel as an alloying element in an amount up to 3.0 percent by weight of the composition, wherein the alloying element is in powder form.

7. The powder composition of claim 1, further comprising molybdenum as an alloying element in an amount up to 3.0 percent by weight of the composition.

8. The powder composition according to claim 5, wherein the alloying element is bound to the iron-based powder particles by means of the binding agent.

9. The powder composition according to claim 5, wherein the alloying element is bound to the iron-based powder particles by means of a thermal diffusion bonding process.

10. The powder composition of claim 7, wherein molybdenum is present in prealloyed form.

11. The powder composition of claim 1, further comprising hard phase materials and/or machinability enhancing agents, in powder form bound to the iron-based powder particles by means of the binding agent.

12. The powder composition of claim 1, wherein the binding agent is a saturated or unsaturated, straight chained or branched, $C_{14}$-$C_{30}$ fatty alcohol.

13. A method for producing a sintered component with improved strength comprising:

providing a powder composition according to claim 1;

subjecting the composition to compaction at between 400 and 2000 MPa to produce a green component;

sintering the green component in a reducing atmosphere at a temperature between 1000-1400° C.; and subjecting the sintered component to heat treatment.

14. The method of claim 13, wherein the heat treatment includes quenching, sinter hardening and/or tempering.

15. A heat treated sintered component produced according to claim 13.

16. A heat treated sintered component produced according to claim 15, wherein the tensile strength is at least 1180 MPa.

17. A heat treated sintered component produced according to claim 15, wherein the fatigue strength, σ50, is above 550 MPa.

18. The powder composition of claim 1, having an apparent density of at least 3.20 $g/cm^3$.

19. The powder composition of claim 1, having a hall flow rate of at most 26 s/50 g.

20. The powder composition according to claim 6, wherein the alloying element is bound to the iron-based powder particles by means of the binding agent.

21. The powder composition according to claim 7, wherein the alloying element is bound to the iron-based powder particles by means of the binding agent.

22. The powder composition of claim 1, having a hall flow rate of at most 24 s/50 g.

23. The powder composition of claim 1, the iron-based powder is present in an amount of at least 90 percent by weight of the composition.

24. The powder composition of claim 12, wherein the fatty alcohol is selected from the group consisting of: cetyl alcohol, stearyl alcohol, arachidyl alcohol, behenyl alcohol and lignoceryl alcohol.

25. The powder composition of claim 12, wherein the flow agent is selected from the group consisting of: metals, metal oxides, silicon oxide carbon black.

26. A bonded metallurgical powder composition comprising:

an iron-based powder having a weight average particle size in the range of 30-50 μm, in an amount of at least 90 percent by weight of the composition;

graphite powder in an amount between 0.15-1.0 percent by weight of the composition;

a fatty alcohol in an amount between 0.05-2.0 percent by weight of the composition, the fatty alcohol selected from the group consisting of: stearyl alcohol, arachidyl alcohol and behenyl alcohol;

carbon black in an amount between 0.001-0.2 percent by weight of the composition;

wherein the graphite powder is bound to the iron-based powder particles by means of the fatty alcohol;

wherein the powder composition has an apparent density of at least 3.20 g/cm$^3$ and a hall flow rate of at most 24 s/50 g; and wherein the difference between the weight average particle size of said iron-based powder and the weight average particle size of said bonded metallurgical powder composition is at most 20%.

* * * * *